US007423598B2

(12) United States Patent
Bit-Babik et al.

(10) Patent No.: US 7,423,598 B2
(45) Date of Patent: Sep. 9, 2008

(54) COMMUNICATION DEVICE WITH A WIDEBAND ANTENNA

(75) Inventors: Giorgi G. Bit-Babik, Sunrise, FL (US); Carlo Dinallo, Plantation, FL (US); Antonio Faraone, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/567,430

(22) Filed: Dec. 6, 2006

(65) Prior Publication Data

US 2008/0136727 A1 Jun. 12, 2008

(51) Int. Cl.
*H01Q 1/24* (2006.01)

(52) U.S. Cl. ..... 343/702; 343/700 MS; 343/846

(58) Field of Classification Search ..... 343/700 MS, 343/702, 846
See application file for complete search history.

(56) References Cited

U.S. PATENT DOCUMENTS

| | | | | |
|---|---|---|---|---|
| 3,587,109 | A | 6/1971 | Martino | |
| 6,762,723 | B2 | 7/2004 | Nallo | |
| 6,867,736 | B2 | 3/2005 | Faraone et al. | |
| 6,982,675 | B2 * | 1/2006 | Kwak et al. | 343/702 |
| 7,339,531 | B2 * | 3/2008 | Desclos et al. | 343/702 |
| 2004/0233111 | A1 | 11/2004 | Desclos | |
| 2007/0069958 | A1 * | 3/2007 | Ozkar | 343/700 MS |
| 2007/0268190 | A1 * | 11/2007 | Huynh | 343/702 |

FOREIGN PATENT DOCUMENTS

GB 2330695 A 4/1999

* cited by examiner

*Primary Examiner*—Tan Ho
(74) *Attorney, Agent, or Firm*—James Lamb; Anthony P. Curtis

(57) ABSTRACT

An apparatus is disclosed for a communication device (100) with a wideband antenna (102) supporting at least two common and one differential resonant modes. An apparatus that incorporates teachings of the present invention may include, for example, the communication device having an antenna (102) that includes a ground structure (202), a first elongated conductor (204) spaced from the ground structure, a second elongated conductor (206) separated from the first elongated conductor, third and fourth conductors (212) each coupled to the first and second elongated conductors forming a gap (205), a ground conductor (208) coupling the ground structure to one among the first and second elongated conductors, and a signal feed conductor (210) coupling to one among the first and second elongated conductors spaced from the ground conductor. Additional embodiments are disclosed. A −10 dB bandwidth of at least 0.5 can be realized using electrical non-congruence.

20 Claims, 4 Drawing Sheets

200

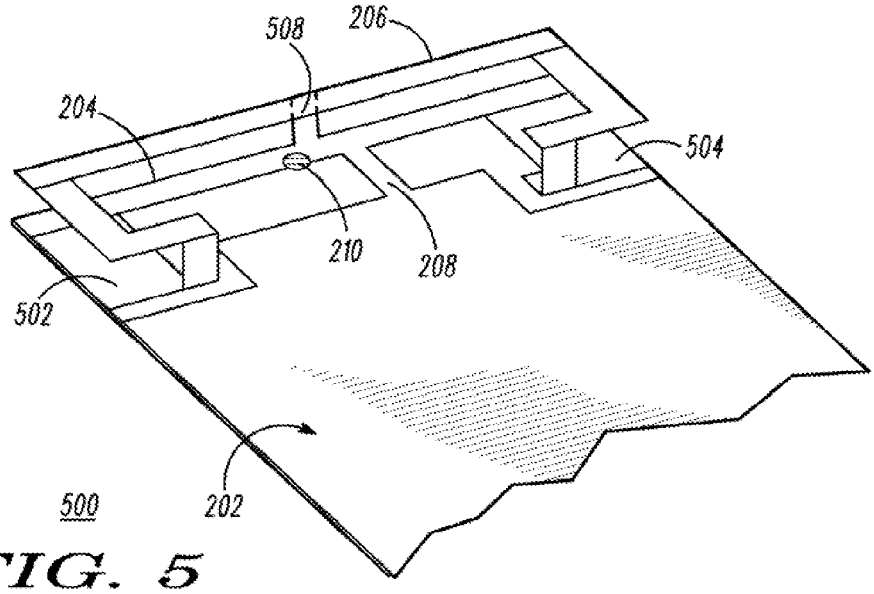
FIG. 5
FIG. 6
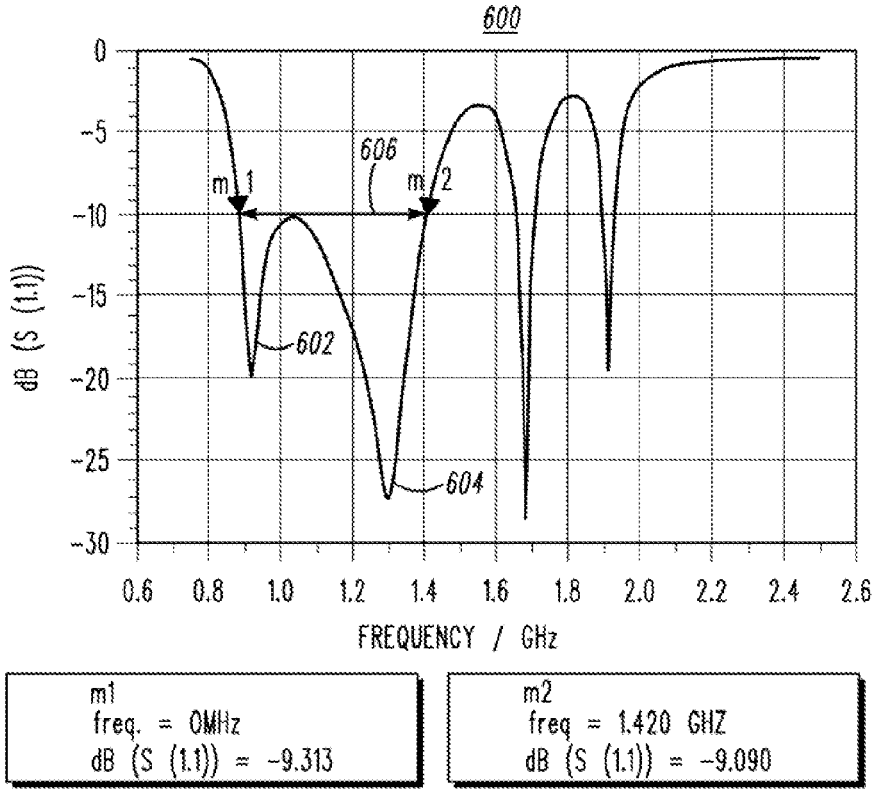

COMMUNICATION DEVICE WITH A WIDEBAND ANTENNA

FIELD OF THE DISCLOSURE

This invention relates generally to antennas, and more particularly to a communication device with a wideband antenna.

BACKGROUND

Demand is increasing for antennas covering a very wide frequency spectrum. Software Defined Radio (SDR) and Ultra Wideband (UWB) applications are examples of anticipated antenna requirements for frequency agility to utilize licensed and unlicensed bands.

A need therefore arises for a communication device with a wideband antenna.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate the embodiments and explain various principles and advantages, in accordance with the present disclosure.

FIGS. 5-6 depict another embodiment of the antenna and its corresponding spectral performance.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION

Figure 1:
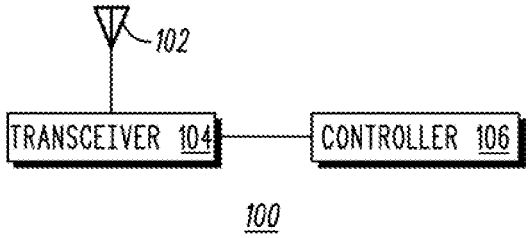
FIG. 1 depicts an exemplary embodiment of a communication device.

FIG. 1 depicts an exemplary embodiment of a communication device 100. The communication device 100 comprises an antenna 102, coupled to a communication circuit embodied as a transceiver 104, and a controller 106. Alternatively, a transmitter or receiver circuit can be used in lieu of the transceiver 104. For illustration purposes only, the communication circuit is assumed to be a transceiver. The transceiver 104 can utilize technology for exchanging radio signals with a radio tower or base station of a wireless communication system or peer-to-peer device communications according to common or future modulation and demodulation techniques. The controller 106 utilizes computing technology such as a microprocessor and/or a digital signal processor with associated storage technology (such as RAM, ROM, DRAM, or Flash) for processing signals exchanged with the transceiver 104 and for controlling general operations of the communication device 100. Alternatively, transceiver 104 and controller 106 could be combined in a single module producing bits-to-RF signal conversion in transmission and reception, according to more advanced electronics envisioned to support software defined radio and other applications in the future.

Figure 2:
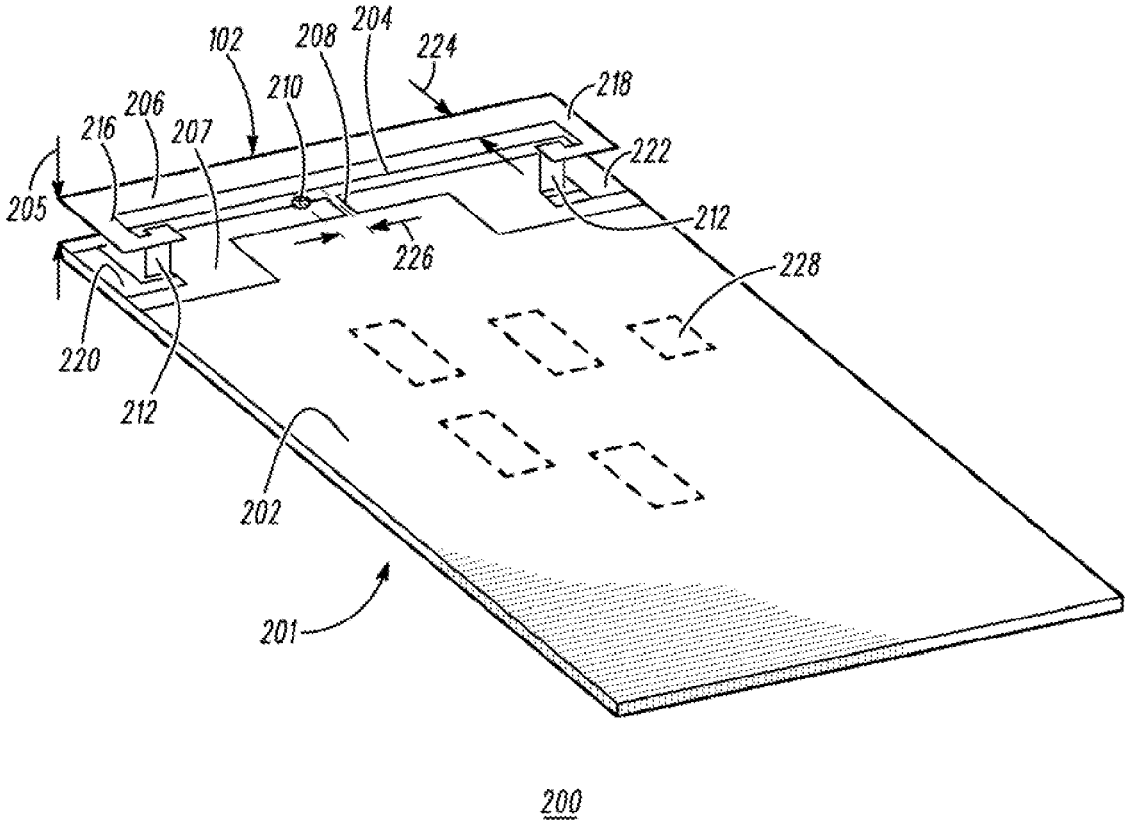
FIG. 2 depicts an exemplary embodiment of a substrate supporting components of the communication device.

FIG. 2 depicts an exemplary embodiment of a substrate 201 supporting the antenna 102, the transceiver 104 and the controller 106 of the communication device 100. The antenna 102 may be defined as a combination of antenna elements 204, 220, 222, 212, and 206, and a ground structure 202. The substrate 201 can be represented by a rigid printed circuit board (PCB) constructed with a common compound such as FR-4, or a flexible PCB made of a compound such as Kapton™ (trademark of DuPont). The substrate 201 can comprise a multi-layer PCB having one layer as a ground structure 202 (or portions of the ground structure 202 dispersed in multiple layers of the PCB). The ground structure 202 can be planar, or a curved surface in the case of a flexible PCB. For convenience, the ground structure 202 will be referred to herein as a ground plane 202 without limiting the possibility that the ground structure can be curved or formed by several inter-coupled conducting sections that do not necessarily belong to the same or any substrate. The PCB can support components 228 making up portions of the transceiver 104 and the controller 106. Suitable ground structures may be constructed from multiple inter-coupled layers or inter-coupled sections as well (for instance, clam shell or slider phones have ground structures that are realized by suitable interconnection of various sub-structures). The extremities of ground structure form an approximately rectangular shape having a length dimension and a width dimension, which may be average dimensions. In some phone designs, such as a clam shell or slider phone, the length of the ground plane may change as the orientation of phone parts is changed. The shape may be approximately rectangular in that it may be, for example tapered or trapezoidal to fit a housing, and as mentioned above, may be curved to conform to a housing, and the edges may not be straight or smooth—for example when an edge of the ground plane has to bypass a feature of a housing such as a plastic mating pin or post.

The antenna 102 can comprise first and second elongated conductors 204, 206 that are substantially co-extensive and substantially aligned to each other in substantially parallel, planar or curved surfaces that are separated by a substantially uniform gap. One of the first and second conductors 204, 206 may be said to be above the other. The first and second elongated conductors 204, 206 can be flat conductors or can have a cylindrical cross-section (such as a wire), and may be curved or be serpentine so as to provide greater electrical length of the elongated conductors 204, 206, and/or to form the elongated conductors 204, 206 around interfering objects, the curving or serpentining being substantially within the respective planar or curved surfaces. A length of each of the elongated conductors 204, 206 is defined as the average length of the two centerlines along the first and second conductors 204, 206, while a physical extent is defined as the maximum distance along the elongated direction of the first and second elongated conductors 204, 206. The planar or curved planes in which the first and second elongated conductors 204, 206 are substantially formed may substantially conform to the shape of a portion of a surface of a housing assembly carrying the communication device 100 of FIG. 1, and one or both of the first and second elongated conductors 204, 206 may be substantially formed adjacent to or on portion(s) of a surface of the housing assembly. The descriptions "substantially aligned", "substantially parallel", "substantially uniform gap", "substantially within", "substantially conform", and "substantially formed", mean that, in some embodiments, the ratio of the closest separation (gap) and largest separation (gap) between the centerlines of the elongated conductors may be up to 1.5:1 In some embodiments this gap variation ratio may be substantially less, such as 1.2:1, or less than 1.05:1. The first and second elongated conductors 204, 206 can have a contour 216-222 as shown in FIG. 2, which may be termed a "U" shape. In the illustration of FIG. 2, the first conductor 204 is co-planar with the ground plane 202. Alternatively, the first conductor 204 can be above or below (e.g., on a back side of the substrate 201) the ground plane 202. In some embodiments, the first and second conductors 204, 206 can be misaligned with respect to each other to some extent within their flat or curved planes. At or near opposing end points of the lengths of the first and second conductors 204, 206, conductors 212 can be orthogonally coupled to the first and second conductors 204, 206 thereby forming a gap 205 determined by a length of the conductors 212, and forming a corresponding electro-magnetic field region having a gap 205 of for example 2.5 mm to 4 mm when the operating frequency of the antenna is approximately 1-2 GHz. Gap 205 can also be formed by suitably shaped spacers and/or dielectric material (not shown) placed between the first and second conductors 204, 206, and the gap 205 may be substantially uniform or may differ along the extension of the antenna element 102, resulting in a gap variation ratio described herein above. When the first and second conductors 204, 206 are formed in curved planes, the gap 205 is a substantially uniform gap. The misalignment mentioned above and the variation of the gap mentioned above are such that the separation of the first and second elongated conductors 204, 206 is within the limit described above. In some embodiments, the average separation (the average gap) of the first and second conductors 204, 206 may approximately 20% of the physical extent described above, while in other embodiments, it may be substantially smaller, such as 5% or less than 1% of the physical extent.

The ground plane 202 is separated from the first conductor 204 by separation 207 (in this example, a non-conducting portion of substrate 201). The ground plane 202 is also separated from the second conductor 206 by a separation (not illustrated in FIG. 2). These separations are such that the average value of the separations is no more than 25% of the physical extent of the first and second elongated conductors 204, 206. A ground conductor 208 can couple the ground plane 202 to the first conductor 204 near the center of the physical extent of the first conductor 204, such as within 5% (physical extent) of the physical center. Alternatively, the ground conductor 208 can couple the ground plane 202 to the second conductor 206 near the center of the physical extent of the second conductor 206, within similar limits. A signal feed conductor couples a signal from an active device to the first conductor 204 and is connected to the first conductor 204 at location 210, in an embodiment in which the ground conductor is coupled to the first conductor 204, near a physical center of the physical extent of the first conductor, such as within 5% (physical extent) of the physical center. The signal conductor comprises, for example, a combination of conductive trace and wire (not shown) that may pass through other layers and couples to a transmitter, receiver, or transceiver mounted on the substrate 201 on a layer isolated from the ground plane 202. There is a separation 226 between the feed point where the ground conductor 208 is attached to the first conductor 204 and the feed point 210 where the signal feed conductor attaches to the first conductor 204. This separation may be small (e.g., less than 10%) compared to the physical extent of the elongated first and second conductors 204, 206. In some embodiments, the ground and signal feed points may be on the same side of the center point of the physical extent, but in many embodiments they may be on opposite sides of the center. As with the ground conductor 208, the signal feed conductor can alternatively be coupled to the second conductor 206. It should be appreciated that the length of the ground conductor 208 from the ground structure 202 to the antenna 102 and the length of a signal feed conductor from the location 210 where it attaches to the antenna 102 need not be the same (assuming that the signal feed conductor is shielded over substantially its entire length). The spatial path traversed by these conductors may be arbitrary (again, assuming that the signal feed conductor is shielded over substantially its entire length). There may be lumped or distributed reactive and resistive elements, e.g., distributed resistances, capacitances, and/or inductances caused by materials that are between the ground and signal feed points or the ground and signal feed conductors or between the signal feed point or signal feed conductor and ground, capacitors, and/or inductors between these the ground and signal feed points or between the signal feed point or signal feed conductor and ground. It should be noticed that the distance between the feed points where the ground and signal feed conductors couple to antenna element 102 and the distance between the points where the ground and signal conductor couple to the printed circuit board structure can be substantially different from each other. Also, the tridimensional path of these conductors, especially the signal conductor, can be arbitrary, and there can be lumped or distributed reactive and resistive elements, e.g., chip resistors, capacitors, or inductors, connected at one or more points along either one of these conductors. The width of the ground plane is defined to be a side that is most closely parallel to the elongated direction of the elongated conductors 204, 206, and the width is substantially similar to the physical extent of the elongated conductors 204, 206, i.e., it is within plus or minus 15% of the physical extent of the elongated conductors. The two elongated conductors are approximately symmetrical with reference to a centerline of the ground plane (a line parallel to the length of the ground plane that divides the ground plane in half).

In some embodiments, another gap (not shown in FIG. 2) may be formed in the first conductor 204 within the separation 226. Alternatively, the other gap could be formed in the second conductor 206 between the ground connection and signal feed point when the ground conductor and signal feed are attached to the second conductor 206. Furthermore, resistive and reactive lumped or distributed elements may be placed or realized across said gaps.

Figure 3:
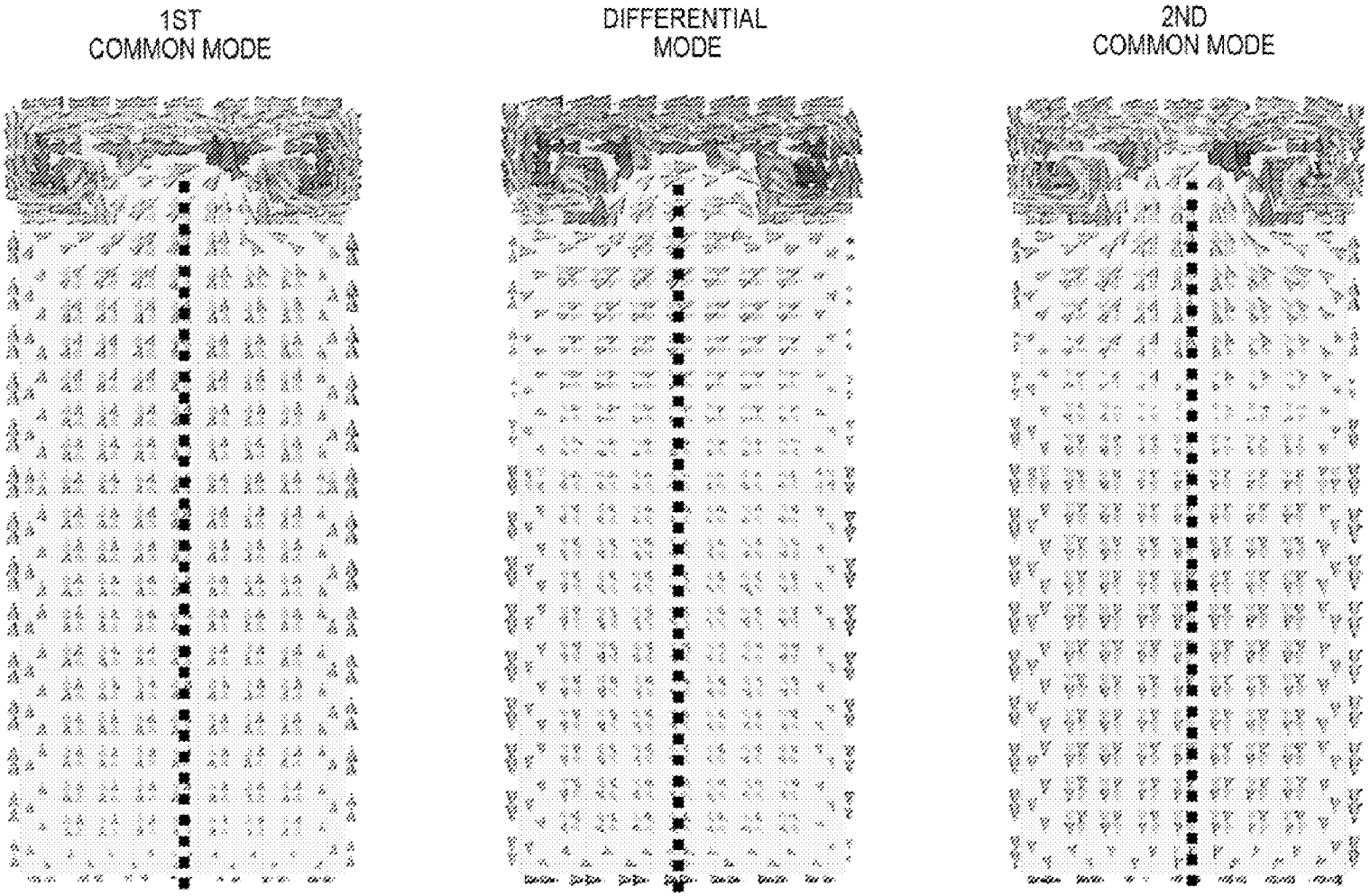
FIGS. 3-4 depict electrical current flow and a corresponding spectral behavior of the reflection coefficient magnitude response in decibels (dB) of an antenna of the communication device for various electro-magnetic modes of operation supported by the antenna.
Figure 4:
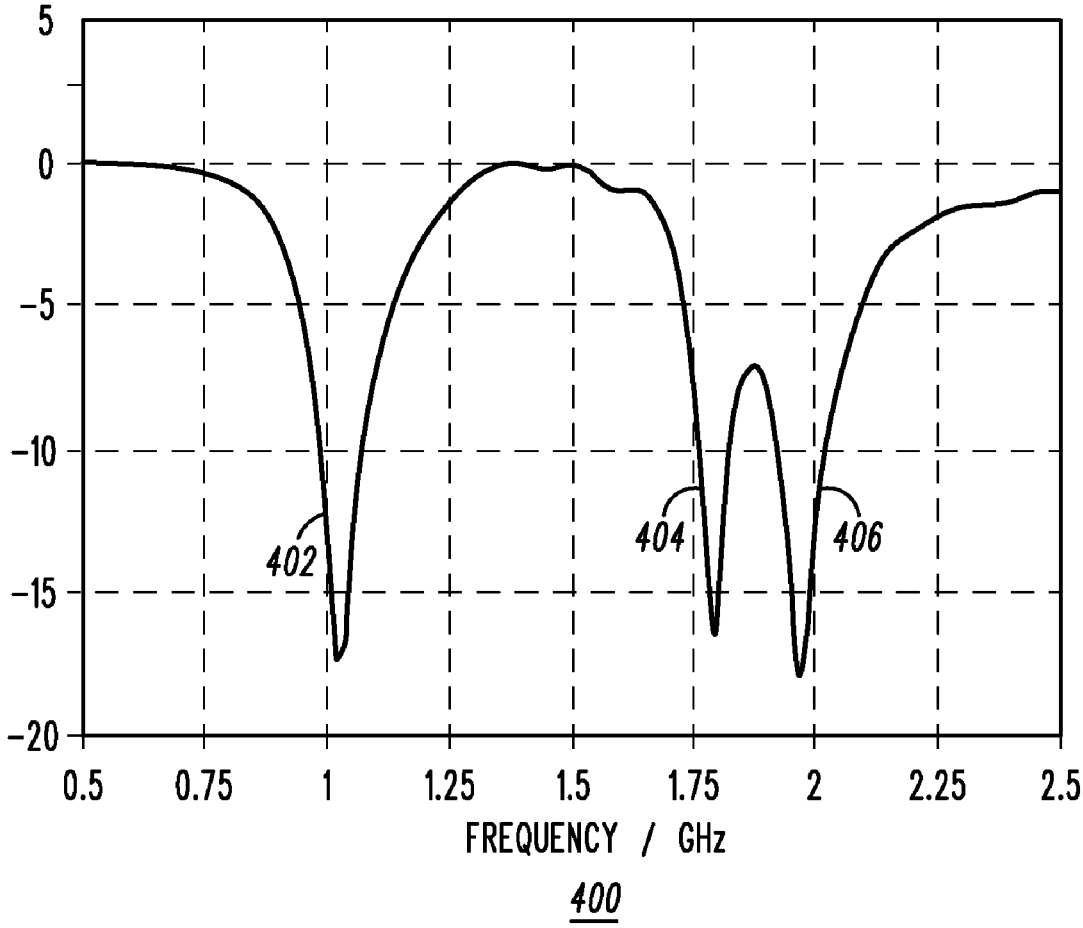

FIGS. 3-4 depict electrical current flow and a corresponding spectral reflection coefficient response of an antenna similar to antenna 102 of FIG. 2, for which the first and second elongated conductors, when analyzed as two antenna elements, are substantially congruent in an electrical sense, by which is meant that the two antenna elements exhibit substantially similar degree and nature of coupling with ground plane—thus providing substantially similar resonant frequency of antenna elements. In these circumstances, the antenna 102 can be analyzed as having three modes of operation: a first common mode 402, a differential mode 404, and a second common mode 406 as depicted in FIG. 3. The contribution of each mode to the performance of the antenna is determined by, among other things, the frequency of the signal being radiated, the geometry of the antenna, and the electrical congruity of the two antenna elements. These modes occur simultaneously, with the radio frequency characteristics of the antenna (spectral shape, bandwidth, beam shape, etc) being determined by a combined effect of the three modes. In some instances (i.e., certain geometry and signal frequency) at least one mode may be excited so negligibly that it might be described as non-existent. Shown in each mode of FIG. 3 is a dashed reference centerline. The first and second common modes are distinguished from the differential mode in that currents flow substantially symmetrical to the center lines of the first and second common modes and substantially anti-symmetrical to the differential mode. The second common mode is distinguished from the first common mode in that there is a phase reversal of current approximately mid-stream of the center reference line. There are several variable design parameters that can affect the characteristics of the modes of operation, including the spectral shape and the operating bandwidth of the antenna 102. These variables can include, without limitation, the size of the gap 205, the size of the separation 226 between the signal feed conductor 210 and the ground conductor 208, a geometric and/or impedance asymmetry between the first and second conductors 204, 206, and a size of the geometry of the ground plane 202. These variables can affect the electrical congruence of the two antenna elements.

For example, as the gap 205 separating the first and second conductors 204, 206 increases, the spectrum of FIG. 4 will typically shift up in frequency, and vice-versa. As the separation 226 between signal feed conductor 210 and the ground conductor 208 decreases the resonant frequency of the first common mode 402 typically shifts down in frequency and its operating bandwidth widens, and the operating frequency of each of the differential mode 404 and second common mode 406 typically widens.

When an electrical non-congruence is created between the first and second conductors 204, 206, the frequency response of the antenna can be dramatically changed, due to the effect of the electrical non-congruence on resonance of the first common mode. Electrical non-congruence between the conductors can be accomplished in a number of ways, and results in a difference of the characteristic electrical lengths of the conductors. One example of such asymmetry is shown in FIG. 5, which is described more fully below. In particular, in an embodiment similar to that shown in FIG. 5, the first common mode resonance can be made to be broad, with two resonant frequencies 602-604, as shown in FIG. 6, which have a substantially wider operating bandwidth 606 (880 MHz-1.42 GHz with a return loss of less than −10 dB) than the spectrum in FIG. 4 This very wide operating range can be used for applications such as software defined radio (SDR) and ultra wide bandwidth radio (UWB radio), or for digital video broadcasting—handhelds (DVB-H) with the overall dimensions of the antenna elements and ground plane adjusted for operation at the assigned frequency bands. It will be noted that the −10 dB bandwidth of the first mode of the antenna represented by FIG. 6 is approximately 49%, while the −10 dB bandwidth of the first mode of the antenna represented by FIG. 4 is approximately 10%. (bandwidth has been calculated by the conventional formula of (upper frequency-lower frequency) divided by the square root of (upper frequency times lower frequency). Accordingly, it is shown that the −10 dB bandwidth of the first common mode of embodiments of antennas described herein has been broadened to be approximately 5 times larger when electrical non-congruence is introduced with respect to embodiments of similar antennas having approximate electrical congruence. Further experiments have established that even greater broadening can be achieved, such as a −10 dB bandwidth of at least 0.5. Thus, electrical non-congruence can provide a bandwidth of the first common mode of greater than 0.5.

Referring again to FIG. 5, the broadness of the first common mode can be accomplished in some embodiments by designing an electrical non-congruence of the antenna elements that is achieved by forming a geometric asymmetry between the first and second conductors 204, 206 at portions 502-504 (refer to FIG. 5) of the first conductor 204 and portions 216-218 of the second conductor. The asymmetry results from portions 216-218 having less surface area than portions 502-504. The wide operating frequency 606 shown in FIG. 6 results from each asymmetric portion 502-504 having slightly different resonances. Alternatively, a geometric asymmetry can be achieved as shown in FIG. 2, by making the width 224 of the second conductor 206 larger than a similar section of the first conductor 204. A wide operating frequency 606 similar to that shown in FIG. 6 can be obtained from appropriate asymmetric widths of the first and second conductors 204, 206. In yet another embodiment, an electrical non-congruence can be created by depositing dielectric material on either of the first and second conductors 204, 206 or placing a dielectric spacer between portions of said conductors. Combinations of these techniques to may be used to optimize the frequency range and improve the return loss of an operating bandwidth of the antenna.

The length of the ground plane 202 can be determined from a desired lowest operating frequency and a fractional wavelength of the antenna 102. For instance, from experimentation of the antenna 102 shown in FIG. 5 a ground plane length 202 of 11 cm provided a lowest operating frequency of 880 MHz (see m1). At this frequency, the wavelength of the antenna 102 can be calculated as 34 cm utilizing the well-known relationship $\lambda=c/f$. From this formula, a length of the ground plane 202 can be determined to be approximately ⅓ (or 11 cm/34 cm) of the wavelength of the lowest operating frequency of the first common mode resonance of the antenna 102. Thus, at a desired operating frequency of 500 MHz the ground plane 202 can be calculated to have a length of approximately 18 cm, $$\lambda = \frac{c}{500\ \text{MHz}} = 60\ \text{cm} \rightarrow \text{Ground_Plane} = 0.3*\lambda = 0.3*60\ \text{cm} = 18\ \text{cm}.$$

The width of the ground plane can be approximately ¼ of the length calculated above. Thus, as the length of the ground plane 202 is increased the lowest operating frequency of the first common mode decreases, and vice-versa. When variations according to embodiments described herein (such as electrical non-congruence, the size of the gap between the elongated elements, a difference between the electrical length of the elongated elements, and the separation of the elongated elements from the ground plane) are taken into account, the length of the ground plane may be between 0.2 and 1.0 times the wavelength of the lowest operating frequency, and the width of the ground plane may be between 0.2 and 1.0 times the length of the ground plane.

A matching circuit can be used to couple the antenna 102 to the transceiver 104. In a supplemental embodiment, a matching impedance between an LC matching circuit of the transceiver 104 and the antenna 102 can be varied by appending conductor 508 between the first and second conductors 204, 206, or by varying a distance between the feed 210 and the ground conductor 208. Thus, conductor 508 can be used to match the impedance of the antenna 102 over a wide operating frequency band 606 as shown in FIG. 6.

The foregoing embodiments of the antenna 102 such as those illustrated in FIGS. 2 and 5 can provide a wideband internal or external antenna design with a wide operating bandwidth which can be contoured to a housing assembly (not shown) of the communication device 100 if desired. It would be evident to one of ordinary skill in the art that the foregoing embodiments can be modified without departing from the scope of the present invention. For example, the first and second conductors 204, 206 and conductors 212 can be formed from a contiguous conductor (such as a wire or folded form cut from one piece of sheet metal) having first and second ends coupled to the signal feed and ground conductors 208-210.

In one embodiment, the antenna has a lowest frequency of operations that is approximately 820 MHz, and the corresponding wavelength is approximately 37 cm. The gap between the first and second elongated conductors averages about 0.1*wavelength, the gap variation ratio is less than 1.5:1, the first and second average separations are each less than 0.3*wavelength, the ground plane has an average length that is about 0.3*wavelength, and the ground plane has an average width of 0.1*wavelength.

In this same embodiment, the antenna the wideband response is 820-1480 MHz at −10 dB, the gap between the first and second elongated conductors averages about 4 mm, a gap variation ratio is less than 1.5:1, the first and second average separations are each less than 10 mm, the ground plane has an average length that is about 95 mm, and the ground plane has an average width of 40 mm.

In another embodiment, the antenna has a lowest frequency of operations of approximately 1.0 GHz, a corresponding wavelength is approximately 30 cm. The average gap between the first and second elongated conductors is approximately 0.008*wavelength, a gap variation ratio is less than 1.5:1, the first and second average separations are each less than 0.03*wavelength, the ground plane has an average length that is approximately 0.3*wavelength, and the ground plane has an average width of 0.2*wavelength.

In this other embodiment, the lowest frequency of operations is approximately 1 GHz, the corresponding wavelength is approximately 30 cm., the average gap between the first and second elongated conductors is about 2.5 mm, a gap variation ratio is less than 1.5:1, the first and second average separations are each less than 10 mm, the ground plane has an average length that is about 90 mm., and the ground plane has an average width of 50 mm.

Accordingly, the specification and figures associated with these embodiments are to be regarded in an illustrative rather than a restrictive sense, and all modifications are intended to be included within the scope of the claims described below. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An antenna, comprising:

a ground structure that is approximately rectangular;

a first elongated conductor separated from the ground structure by a first average separation;

a second elongated conductor above the first elongated conductor, separated from the first elongated conductor by a gap, and separated from the ground structure by a second average separation;

third and fourth conductors each connected to the first and second elongated conductors near opposing end points of lengths of the first and second elongated conductors, wherein a length of the third and fourth conductors determine the size of the gap at their connections;

a ground conductor coupling the ground structure to one among the first and second elongated conductors; and a signal feed conductor coupling to the same one among the first and second elongated conductors, spaced from the ground conductor by a separation of a third value.

2. The antenna of claim 1, wherein an average of the gap between the first and second elongated conductors is less than 20% of a physical extent of the first and second elongated conductors, and a gap variation ratio is less than 1.5:1, and wherein the first and second average separations are each less than 25% of the physical extent of the first and second elongated conductors, and wherein the ground plane has an average length that is between 20% and 100% of the wavelength of a lowest operating frequency of the antenna, and wherein the ground plane has an average width that is less than the average length and the average width is within plus or minus 10% of a physical extent of the first and second elongated conductors.

3. The antenna of claim 2, wherein the gap between the first and second elongated conductors averages about 0.01*wavelength, and wherein the first and second average separations are each less than 0.03*wavelength, and wherein the ground plane has an average length that is about 0.3*wavelength, and wherein the ground plane has an average width of 0.1*wavelength.

4. The antenna of claim 2, wherein the lowest operating frequency is approximately 820 MHz, the wideband response is 820-1480 MHz at −10 dB, and wherein the gap between the first and second elongated conductors averages about 4 mm, and wherein the first and second average separations are each less than 10 mm, and wherein the ground plane has an average length that is about 95 mm, and wherein the ground plane has an average width of 40 mm.

5. The antenna of claim 2, wherein the average gap between the first and second elongated conductors is approximately 0.008*wavelength, and wherein the first and second average separations are each less than 0.03*wavelength, and wherein the ground plane has an average length that is approximately 0.3*wavelength, and wherein the ground plane has an average width of 0.2*wavelength.

6. The antenna of claim 2, wherein the lowest frequency of operations is approximately 1 GHz, the corresponding wavelength is approximately 30 cm., and wherein the average gap between the first and second elongated conductors is about 2.5 mm, and wherein the first and second average separations are each less than 10 mm, and wherein the ground plane has an average length that is about 90 mm, and wherein the ground plane has an average width of 50 mm.

7. The antenna of claim 1, wherein an electrical non-congruence is designed to form an operational frequency range of the antenna that is based on operation of the antenna at operational frequencies at which a first common mode response of the antenna is dominant, wherein the first common mode is characterized by having substantially symmetric currents with respect to the centerline at the antenna elements and the ground structure, and wherein the electric current distribution along the ground plane does not exhibit a phase reversal.

8. The antenna of claim 7, wherein the electrical non-congruence is an electrical non-congruence of radiating elements of the antenna, wherein the radiating elements comprise the first and second elongated conductors and the non-congruence is a function of at least one of: a physical asymmetry of the first and second elongated elements, a separation of the ground and signal feed points at one of the first and second elongated conductors, an off center orientation of the ground and signal feed points from the center of the physical extent of the first and second elongated conductors, different dielectric coupling between the first and second elongated conductors and ground; and different lumped element coupling between the first and second elongated conductors and ground.

9. The antenna of claim 8, wherein the physical asymmetry comprises at least one of a difference of surface areas and lengths of the first and second elongated conductors.

10. The antenna of claim 1, wherein the antenna produces a frequency spectrum comprising at least one of a first common mode frequency response, a differential mode frequency response, and a second common mode frequency response.

11. The antenna of claim 1, comprising a substrate for supporting the ground structure, wherein the substrate comprises a printed circuit board (PCB), wherein the ground structure has a geometry extending throughout a substantial portion of the PCB and spaced from the first and second elongated conductors.

12. The antenna of claim 1, comprising a fifth conductor coupled to the first and second elongated conductors located between the signal feed conductor and the ground conductor for tuning a matching impedance of the antenna.

13. The antenna of claim 1, wherein the first and second elongated conductors have U-shaped contour.

14. The antenna of claim 1, wherein the first and second elongated conductors comprise elongated flat conductors.

15. The antenna of claim 1, wherein the first and second elongated conductors, and the third and fourth conductors coupled thereto form a contiguous conductor assembly having first and second ends coupled to the signal feed conductor and the ground conductor.

16. The antenna of claim 1, wherein the third and fourth conductors are orthogonally coupled to the first and second elongated conductors.

17. A communication device, comprising:

an antenna;

communication circuitry coupled to the antenna; and a controller programmed to cause the communication circuitry to process signals associated with a wireless communication system, and wherein the antenna comprises:

a ground structure supported by a layer of a printed circuit board (PCB);

a first elongated conductor spaced from the ground structure by an insulating material;

a second elongated conductor above the first elongated conductor;

third and fourth conductors each coupled to the first and second elongated conductors forming a gap and a corresponding electromagnetic field region;

a ground conductor coupling the ground structure to one among the first and second elongated conductors; and a signal feed conductor coupling to one among the first and second elongated conductors and spaced from the ground conductor.

18. The communication device of claim 17, comprising a housing assembly for carrying the components of the communication device, wherein the first and second elongated conductors have a first contour similar to a second contour of the housing assembly.

19. A communication device, comprising:

an antenna;

communication circuitry coupled to the antenna; and a controller programmed to cause the communication circuitry to process signals associated with a wireless communication system, and wherein the antenna comprises:

a ground plane supported by a substrate;

a first elongated conductor spaced from the ground plane;

a second elongated conductor above the first elongated conductor, wherein the first and second elongated conductors have a U-shaped contour;

third and fourth conductors each coupled orthogonally to the first and second elongated conductors forming a gap;

a ground conductor coupling the ground plane to one among the first and second elongated conductors; and a signal feed conductor coupling to one among the first and second elongated conductors and spaced from the ground conductor.

20. The communication device of claim 19, wherein there exists an electrical non-congruence between the first and second elongated conductors, thereby forming a common mode frequency response of the antenna having a bandwidth that is at least 0.5.

* * * * *